US009939162B2

(12) United States Patent
Kriz et al.

(10) Patent No.: US 9,939,162 B2
(45) Date of Patent: Apr. 10, 2018

(54) HVAC BOILER CONTROLLER

(71) Applicant: Honeywell International Inc., Morristown, NJ (US)

(72) Inventors: Milan Kriz, Rajecko (CZ); Petr Wagner, Olomouc (CZ)

(73) Assignee: Honeywell International Inc., Morris Plains, NJ (US)

( * ) Notice: Subject to any disclaimer, the term of this patent is extended or adjusted under 35 U.S.C. 154(b) by 210 days.

(21) Appl. No.: 14/940,682

(22) Filed: Nov. 13, 2015

(65) Prior Publication Data

US 2017/0138624 A1 May 18, 2017

(51) Int. Cl.
*F24F 11/00* (2006.01)
*F24D 19/10* (2006.01)

(52) U.S. Cl.
CPC ..... *F24D 19/1081* (2013.01)

(58) Field of Classification Search
CPC ..... F24F 11/001; F24D 19/1081; G05B 2219/2614
See application file for complete search history.

(56) References Cited

U.S. PATENT DOCUMENTS 9,557,068 B2 * 1/2017 Honma ..... F24D 19/1048
2010/0266738 A1 * 10/2010 Wisner ..... A47J 39/006 426/394
2012/0205456 A1 * 8/2012 Honma ..... F24D 19/1048 237/2 B
2013/0073094 A1 * 3/2013 Knapton ..... F24F 11/0034 700/278
2014/0277817 A1 * 9/2014 Stevens ..... G05D 23/1917 700/300

* cited by examiner

*Primary Examiner* — Charles Kasenge
(74) *Attorney, Agent, or Firm* — Brooks, Cameron & Huebsch, PLLC

(57) ABSTRACT

A heating, ventilation, and air conditioning (HVAC) boiler controller is described herein. One HVAC boiler controller includes a memory and a processor configured to execute executable instructions stored in the memory to receive a weather forecast for an area in which the boiler of the HVAC system is located, receive a current outdoor temperature, determine a set point of the boiler based, at least in part, on the received weather forecast and the received current outdoor temperature, and adjust the set point of the boiler to the determined set point.

18 Claims, 3 Drawing Sheets

HVAC BOILER CONTROLLER

TECHNICAL FIELD

The present disclosure relates to a heating, ventilation, and air conditioning (HVAC) boiler controller.

BACKGROUND

A heating, ventilation, and air conditioning (HVAC) system can be used to control the environment of a facility (e.g., a home or commercial building). For example, an HVAC system can be used to control the air temperature, humidity, and/or air quality of a facility.

One component of an HVAC system used to control the environment of the facility is a boiler (e.g., boiler plant). The operation of the boiler, and therefore the environment of the facility, can be controlled by controlling the set point(s) of the boiler, such as the supply (e.g., output) water temperature, for example.

Previous HVAC systems, including previous boilers, may operate on the basis of reactive control (e.g., they may only react to currently existing conditions that may have already caused the environment of the facility to become unsatisfactory). For instance, the operation (e.g., set point(s)) of boilers of previous HVAC systems may be adjusted based on the current outdoor temperature, as sensed by an outdoor temperature sensor of the HVAC system.

Such a reactive approach, however, may be inefficient (e.g., use a large amount of energy) and/or ineffective at controlling the environment of the facility in a satisfactory manner due to, for example, the large amount of time it may take for the HVAC system (e.g., boiler) to adjust to the current conditions (e.g., it may take the HVAC system a long time to react to and/or compensate for a change in the current conditions in the environment of the facility). Further, the current outdoor temperature, as determined by the outdoor temperature sensor of the HVAC system, on which the adjustment is based may be inaccurate and/or unreliable due to, for example, lengthy wiring, electromagnetic interference, and/or a failure (e.g., fault and/or malfunction) of the temperature sensor occurring.

DETAILED DESCRIPTION

Figure 1:
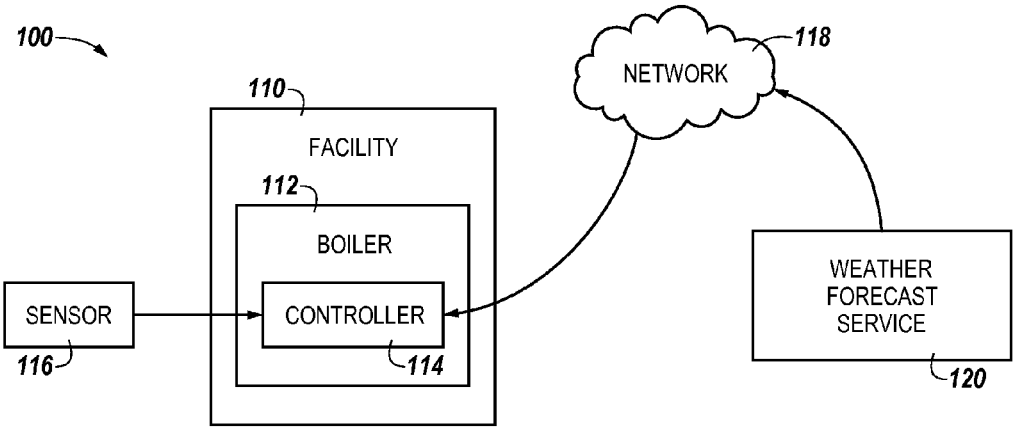
FIG. 1 illustrates an example of a system for controlling a boiler of an HVAC system in accordance with one or more embodiments of the present disclosure.

A heating, ventilation, and air conditioning (HVAC) boiler controller is described herein. For example, one or more embodiments include a memory and a processor configured to execute executable instructions stored in the memory to receive a weather forecast for an area in which the boiler of the HVAC system is located, receive a current outdoor temperature, determine a set point of the boiler based, at least in part, on the received weather forecast and the received current outdoor temperature, and adjust the set point of the boiler to the determined set point.

An HVAC boiler controller in accordance with the present disclosure can be a predictive (e.g., rather than reactive) controller. For instance, an HVAC boiler controller in accordance with the present disclosure can adjust the operation (e.g., set point(s)) of the boiler in anticipation of future conditions of the environment of a facility (e.g., in anticipation of future changes to the conditions), such as, for instance, an increase in outdoor temperature, that would cause the environment of the facility to become unsatisfactory. Further, an HVAC boiler controller in accordance with the present disclosure may not rely exclusively, or even at all, on an outdoor temperature sensor of the HVAC system to determine the current outdoor temperature at the facility, and as such may not be susceptible to inaccuracy and/or unreliability issues that may arise with such an outdoor temperature sensor. Accordingly, an HVAC boiler controller in accordance with the present disclosure can be more efficient (e.g., use less energy) and/or effective at controlling the environment of the facility in a satisfactory manner than previous (e.g., reactive) boiler control approaches.

In the following detailed description, reference is made to the accompanying drawings that form a part hereof. The drawings show by way of illustration how one or more embodiments of the disclosure may be practiced.

These embodiments are described in sufficient detail to enable those of ordinary skill in the art to practice one or more embodiments of this disclosure. It is to be understood that other embodiments may be utilized and that mechanical, electrical, and/or process changes may be made without departing from the scope of the present disclosure.

As will be appreciated, elements shown in the various embodiments herein can be added, exchanged, combined, and/or eliminated so as to provide a number of additional embodiments of the present disclosure. The proportion and the relative scale of the elements provided in the figures are intended to illustrate the embodiments of the present disclosure, and should not be taken in a limiting sense.

The figures herein follow a numbering convention in which the first digit or digits correspond to the drawing figure number and the remaining digits identify an element or component in the drawing. Similar elements or components between different figures may be identified by the use of similar digits. For example, 114 may reference element "14" in FIG. 1, and a similar element may be referenced as 214 in FIG. 2.

As used herein, "a" or "a number of" something can refer to one or more such things. For example, "a number of facilities" can refer to one or more facilities.

FIG. 1 illustrates an example of a system 100 for controlling a boiler (e.g., boiler 112) of a heating, ventilation, and air conditioning (HVAC) system in accordance with one or more embodiments of the present disclosure. The HVAC system can be, for example, the HVAC system of facility 110. That is, boiler 112 can be a component of the HVAC system used to control the environment (e.g., the air temperature, humidity, and/or air quality) of facility 110. For instance, boiler 112 can be a boiler plant that includes boiler 112 and a number of water pumps. Facility 110 can be, for example, a home or a commercial building, among other types of facilities.

As shown in FIG. 1, system 100 can include a boiler controller 114. In the example shown in FIG. 1, controller 114 is included in (e.g., located within) boiler 112. However, embodiments of the present disclosure are not so limited.

For example, in some embodiments, controller 114 may be separate from (e.g., located outside of) boiler 112. That is, in some embodiments, controller 114 can be a stand-alone device. An example of controller 114 will be further described herein (e.g., in connection with FIG. 4).

In the example illustrated in FIG. 1, system 100 includes a local outdoor temperature sensor 116. Outdoor temperature sensor 116 can sense the current outdoor temperature at the location of facility 110. Outdoor temperature sensor 116 can be directly connected to (e.g., in direct communication with) controller 114 via a direct wired or wireless connection, and controller 114 can receive the current outdoor temperature from outdoor temperature sensor 116 via the direct connection.

In the example illustrated in FIG. 1, controller 114 can also receive a weather forecast for the area (e.g., geographic location or region) in which facility 110 (e.g., boiler 112) is located. For instance, the weather forecast may be for the city or zip code in which facility 110 (e.g., boiler 112) is located. The location of facility 110 (e.g., boiler 112) can be configured during installation and/or commissioning of boiler 112 and/or controller 114, or controller 114 can have geolocation capabilities to determine its location during operation.

Controller 114 can receive the weather forecast from a third party weather forecast service 120 via network 118, as illustrated in FIG. 1. Weather forecast service 120 can be, for example, the National Weather Service or a website such as www.accuweather.com. However, embodiments of the present disclosure are not limited to a particular weather forecast service.

Network 118 illustrated in FIG. 1 can be a network relationship through which controller 114 and weather forecast service 120 can communicate. Examples of such a network relationship can include a distributed computing environment (e.g., a cloud computing environment), a wide area network (WAN) such as the Internet, a local area network (LAN), a personal area network (PAN), a campus area network (CAN), or metropolitan area network (MAN), among other types of network relationships. For instance, network 118 can include a number of servers that receive the weather forecast from weather forecast service 120 via a wired or wireless network, and send the received weather forecast to controller 114 via a wired or wireless network. Further, controller 114 can send the location of facility 110 (e.g., boiler 112) to the server(s), to ensure that controller 114 receives the correct weather forecast (e.g., the forecast for the location of facility 110).

As used herein, a "network" (e.g., network 118) can provide a communication system that directly or indirectly links two or more computers and/or peripheral devices and allows users to access resources on other computing devices and exchange messages with other users. A network can allow users to share resources on their own systems with other network users and to access information on centrally located systems or on systems that are located at remote locations. For example, a network can tie a number of computing devices together to form a distributed control network (e.g., cloud).

A network may provide connections to the Internet and/or to the networks of other entities (e.g., organizations, institutions, etc.). Users may interact with network-enabled software applications to make a network request, such as to get a file or print on a network printer. Applications may also communicate with network management software, which can interact with network hardware to transmit information between devices on the network.

The weather forecast received by controller 114 from weather forecast service 120 can include, for example, a forecast temperature (e.g., forecast temperature curve), forecast wind speed, forecast humidity, and/or forecast sunlight intensity for the area in which facility 110 is located. In some embodiments, the weather forecast may also include the current outdoor temperature, the current wind speed, the current humidity, and/or the current sunlight intensity for the area in which facility 110 is located (e.g., the current outdoor temperature, wind speed, humidity, and/or sunlight intensity for the area in which facility 110 is located can be received with the forecast).

The weather forecast can be the forecast for a particular time period, such as, for instance, the next two or three hours, the next 24 hours, or the next day. Further, controller 114 may receive the weather forecast from weather forecast service 120 periodically. For instance, controller 114 may receive the weather forecast once an hour, once a day, etc. The accuracy and/or reliability of the weather forecast may depend on the time period for the forecast and/or the frequency with which the forecast is received (e.g., the shorter the time period and/or higher the frequency, the greater the accuracy and/or reliability of the forecast). However, embodiments of the present disclosure are not limited to particular information that can be included in the forecast, a particular time period for the forecast, or a particular frequency with which the forecast can be received.

Controller 114 can determine (e.g., calculate) the set point of (e.g., for) boiler 112 based on the weather forecast (e.g., the forecast temperature, wind speed, humidity, and/or sunlight intensity) received from weather forecast service 120, the current outdoor temperature received from (e.g., sensed by) outdoor temperature sensor 116, and the outdoor reset curve (e.g., algorithm) of boiler 112 set up during installation and/or commissioning of boiler 112 and/or controller 114, and controller 114 can adjust the set point of boiler 112 to the determined set point. That is, controller 114 can adjust the set point of boiler 112 based on the weather forecast, current outdoor temperature, and outdoor reset curve. As such, controller 114 can be a predictive (e.g., rather than reactive) controller.

For example, controller 114 can decrease the set point of boiler 112 upon the weather forecast indicating the temperature in the area in which facility 110 is located will increase above a particular temperature and/or will increase by more than a particular amount within a particular amount of time (e.g., indicating that a significant temperature increase will occur in the area). The set point can be, for example, the set point of the supply (e.g., output) water temperature of boiler 112, the set point of the pump speed of boiler 112, or the maximum achievable firing rate of boiler 112 if boiler 112 is a modulating boiler. Further, controller 114 can adjust its outdoor reset curve based on the weather forecast and current outdoor temperature.

Figure 2:
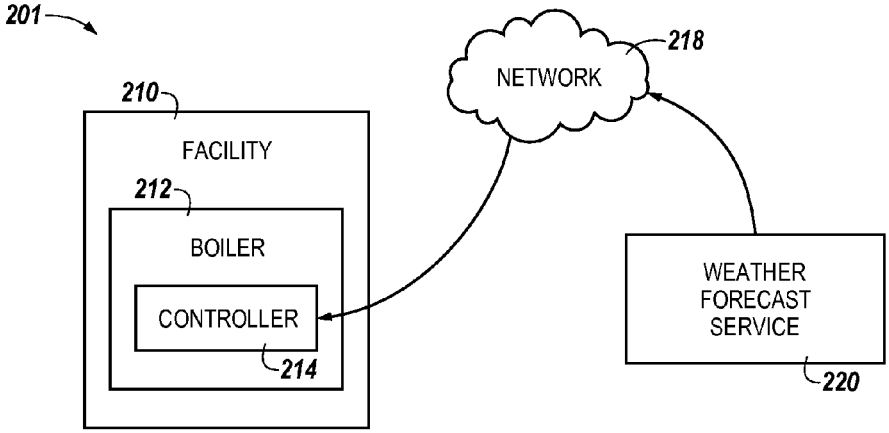
FIG. 2 illustrates an additional example of a system for controlling a boiler of an HVAC system in accordance with one or more embodiments of the present disclosure.

FIG. 2 illustrates an additional example of a system 201 for controlling a boiler (e.g., boiler 212) of an HVAC system in accordance with one or more embodiments of the present disclosure. The HVAC system can be, for example, the HVAC system of facility 210, in a manner analogous to facility 110 previously described in connection with FIG. 1.

As shown in FIG. 2, system 201 can include a boiler controller 214. Controller 214 can be included in, or be separate from, boiler 212, in a manner analogous to controller 114 previously described in connection with FIG. 1.

In the example illustrated in FIG. 2, system 201 does not include a local outdoor temperature sensor (e.g., no outdoor temperature sensor is installed) to sense the current outdoor temperature at the location of facility 210. That is, in the example illustrated in FIG. 2, controller 214 does not receive the current outdoor temperature from a local outdoor temperature sensor associated with boiler 212 at facility 210.

In the example illustrated in FIG. 2, controller 214 can receive a weather forecast for the area in which facility 210 (e.g., boiler 212) is located from a third party weather forecast service 220 via network 218, in a manner analogous to that previously described in connection with FIG. 1. For instance, network 218 can be a cloud computing environment that includes a number of servers that can receive the weather forecast from weather forecast service 220 via a wired or wireless network, and send the received weather forecast to controller 214 via a wired or wireless network, in a manner analogous to that previously described in connection with FIG. 1.

The weather forecast received from weather forecast service 220 can be analogous to the weather forecast received from weather forecast service 120 previously described in connection with FIG. 1. For example, the weather forecast can include the current outdoor temperature, current wind speed, current humidity, and/or current sunlight intensity for the area in which facility 210 is located.

Controller 214 can determine (e.g., calculate) the set point of (e.g., for) boiler 212 based on the weather forecast, including the current outdoor temperature, wind speed, humidity, and/or sunlight intensity, received from weather forecast service 220, and the outdoor reset curve (e.g., algorithm) of boiler 212 set up during installation and/or commissioning of boiler 212 and/or controller 214, and controller 214 can adjust the set point of boiler 212 to the determined set point. That is, controller 214 can adjust the set point of boiler 212 based on the weather forecast, including the current outdoor temperature, received from weather forecast service 220, and the outdoor reset curve. As such, controller 214 can be a predictive controller, in a manner analogous to controller 114 previously described in connection with FIG. 1.

In the example illustrated in FIG. 2, however, the determination and adjustment of the set point of boiler 212 is not based on a potentially inaccurate and/or unreliable outdoor temperature sensed by a local outdoor temperature sensor associated with boiler 212 at facility 210. That is, in the example illustrated in FIG. 2, the current outdoor temperature received with the weather forecast from weather forecast service 220 can be used as a replacement for a local outdoor temperature sensor at facility 210.

As an example, controller 214 can decrease the set point of boiler 212 upon the weather forecast and/or current temperature received from weather forecast service 220 indicating the temperature in the area in which facility 210 is located will increase above a particular temperature and/or will increase by more than a particular amount within a particular period of time (e.g., indicating that a significant temperature increase will occur in the area). The set point can be, for example, the set point of the supply (e.g., output) water temperature of boiler 212, or the set point of the pump speed of boiler 212. Further, controller 214 can adjust its outdoor reset curve based on the weather forecast and current outdoor temperature received from weather forecast service 220.

Figure 3:
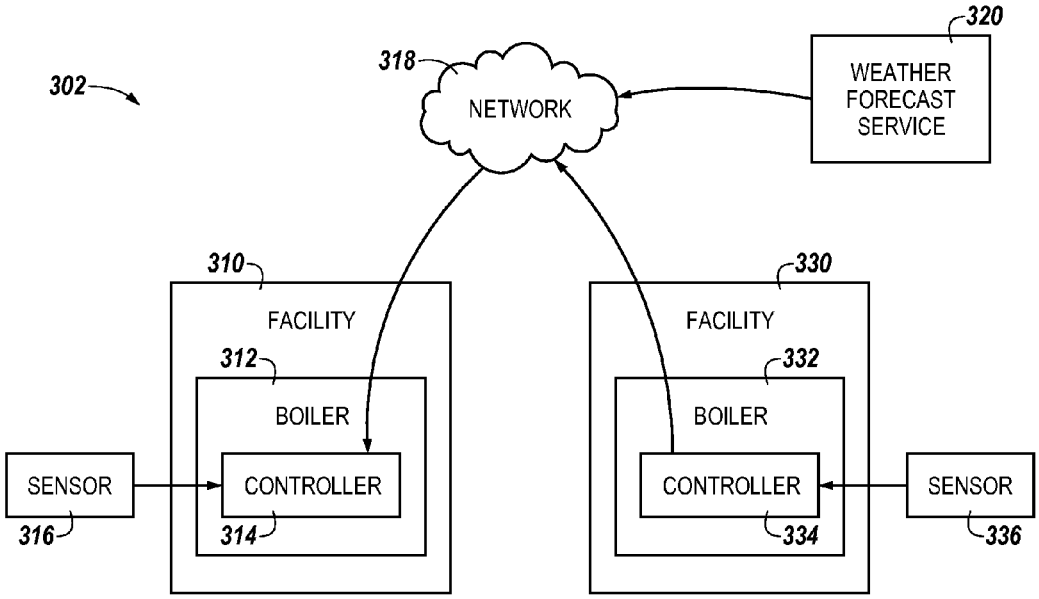
FIG. 3 illustrates an additional example of a system for controlling a boiler of an HVAC system in accordance with one or more embodiments of the present disclosure.

FIG. 3 illustrates an additional example of a system 302 for controlling a boiler (e.g., boiler 312) of an HVAC system in accordance with one or more embodiments of the present disclosure. The HVAC system can be, for example, the HVAC system of facility 310, in a manner analogous to facilities 110 and 210 previously described in connection with FIGS. 1 and 2, respectively.

As shown in FIG. 3, system 302 can include a boiler controller 314. Controller 314 can be included in, or be separate from, boiler 312, in a manner analogous to controllers 114 and 214 previously described in connection with FIGS. 1 and 2, respectively.

In the example illustrated in FIG. 3, system 302 includes a local outdoor temperature sensor 316. Outdoor temperature sensor 316 can sense the current outdoor temperature at the location of facility 310, and controller 314 can receive the current outdoor temperature from outdoor temperature sensor 316, in a manner analogous to that previously described in connection with FIG. 1.

In the example illustrated in FIG. 3, controller 314 can receive a weather forecast for the area in which facility 310 (e.g., boiler 312) is located from a third party weather forecast service 320 via network 318, in a manner analogous to that previously described in connection with FIGS. 1 and 2. For instance, network 318 can be a cloud computing environment that includes a number of servers that can receive the weather forecast from weather forecast service 320 via a wired or wireless network, and send the received weather forecast to controller 314 via a wired or wireless network, in a manner analogous to that previously described in connection with FIGS. 1 and 2.

The weather forecast received from weather forecast service 320 can be analogous to the weather forecast received from weather forecast service 120 and 220 previously described in connection with FIGS. 1 and 2, respectively. For example, the weather forecast can include the current outdoor temperature for the area in which facility 310 is located.

In the example illustrated in FIG. 3, system 302 also includes a boiler controller 334 for a boiler 332 of an HVAC system of an additional facility 330. Controller 334 can be included in or separate from boiler 332, in a manner analogous to controller 314. Facility 330 can be, for example, a home or commercial building, and can be located in the same area as facility 310. For instance, facility 330 may be located in the same neighborhood as facility 310.

In the example illustrated in FIG. 3, system 302 also includes an additional local outdoor temperature sensor 336. Outdoor temperature sensor 336 can sense the current outdoor temperature at the location of facility 330, and controller 334 can receive the current outdoor temperature from outdoor temperature sensor 336, in a manner analogous to outdoor temperature sensor 316 and controller 314.

Although one additional facility, boiler, boiler controller, and local outdoor temperature sensor are illustrated in FIG. 3, embodiments of the present disclosure are not so limited. For example, system 302 can include any number of additional facilities analogous to facility 330, each with its own respective boiler, boiler controller, and local outdoor temperature sensor analogous to boiler 332, controller 334, and sensor 336, respectively.

In the example illustrated in FIG. 3, controller 314 can receive the current outdoor temperature from (e.g., sensed by) outdoor temperature sensor 336 via network 318. For instance, in embodiments in which network 318 is a cloud computing environment, the servers of the cloud computing environment can receive the current outdoor temperature sensed by outdoor temperature sensor 336 from controller 334 via a wired or wireless network, and send the received current outdoor temperature to controller 314 via a wired or wireless network, in a manner analogous to the weather forecast received from weather forecast service 320. Further, the servers can process the current outdoor temperature received from controller 334 before sending the current outdoor temperature to controller 314. For example, in embodiments in which system 302 includes additional facilities analogous to facility 330 (e.g., in which the server may also receive the current outdoor temperature sensed by the outdoor temperature sensors of those facilities), the servers may aggregate and/or average the current outdoor temperatures received from each different outdoor temperature sensor into a single current outdoor temperature value, and send this value to controller 314 as the current outdoor temperature.

Controller 314 can determine (e.g., calculate) the set point of (e.g., for) boiler 312 based on the weather forecast received from weather forecast service 320, the current outdoor temperature received from (e.g., sensed by) outdoor temperature sensor 316, and the outdoor reset curve (e.g., algorithm) of boiler 312 set up during installation and/or commissioning of boiler 312 and/or controller 314, and controller 314 can adjust the set point of boiler 312 to the determined set point. That is, controller 314 can adjust the set point of boiler 312 based on the weather forecast, current outdoor temperature, and outdoor reset curve, in a manner analogous to controller 114 described in connection with FIG. 1. As such, controller 314 can be a predictive (e.g., rather than reactive) controller. The set point can be, for example, the set point of the supply (e.g., output) water temperature of boiler 312, or the set point of the pump speed of boiler 312. Further, controller 314 can adjust its outdoor reset curve based on the weather forecast and current outdoor temperature received from weather forecast service 320.

In some instances, however, a failure (e.g., a malfunction and/or fault) of outdoor temperature sensor 316 may occur. In such an instance (e.g., upon failure of outdoor temperature sensor 316), controller 314 can determine and adjust the set point of boiler 312 based on the current outdoor temperature received from weather forecast service 320 and/or the current outdoor temperature received from outdoor temperature sensor 336, and not based on the current outdoor temperature received from outdoor temperature sensor 316. That is, the current outdoor temperature received from weather forecast service 320 and/or outdoor temperature sensor 336 can be used as a backup for the temperature received from outdoor temperature sensor 316, in case a failure of outdoor temperature sensor 316 occurs.

Further, in some embodiments, system 302 may not include outdoor temperature sensor 316 (e.g., no outdoor temperature sensor may be installed at facility 310). In such embodiments, weather forecast service 320 and/or outdoor temperature sensor 336 may be the sole source(s) of the current outdoor temperature for controller 314. That is, in such embodiments, controller 314 may rely solely on the current outdoor temperature received via network 318.

Controller 314 can determine a failure of outdoor temperature sensor 316 has occurred based on a comparison of the current outdoor temperature received from outdoor temperature sensor 316 and the current outdoor temperature received from weather forecast service 320 and/or outdoor temperature sensor 336. For example, if the comparison indicates that the difference between the current outdoor temperature received from outdoor temperature sensor 316 and the current outdoor temperature received from weather forecast service 320 and/or outdoor temperature sensor 336 meets or exceeds a particular threshold, controller 314 can determine that a failure of outdoor temperature sensor 316 has occurred. The comparison can be made over a particular period of time (e.g., 24 hours). Upon determining the failure has occurred, controller 314 can determine and adjust the set point of boiler 312 based on the current outdoor temperature received from weather forecast service 320 and/or the current outdoor temperature received from outdoor temperature sensor 336, and not based on the current outdoor temperature received from outdoor temperature sensor 316.

Controller 314 can provide an indication of the failure of outdoor temperature sensor 316 to a user. For example, controller 314 can display the indication of the failure to the user on a user interface, as will be further described herein (e.g., in connection with FIG. 4), and/or send the indication of the failure to the user via email or text. The user can than repair or replace outdoor temperature sensor 316, as needed.

Figure 4:
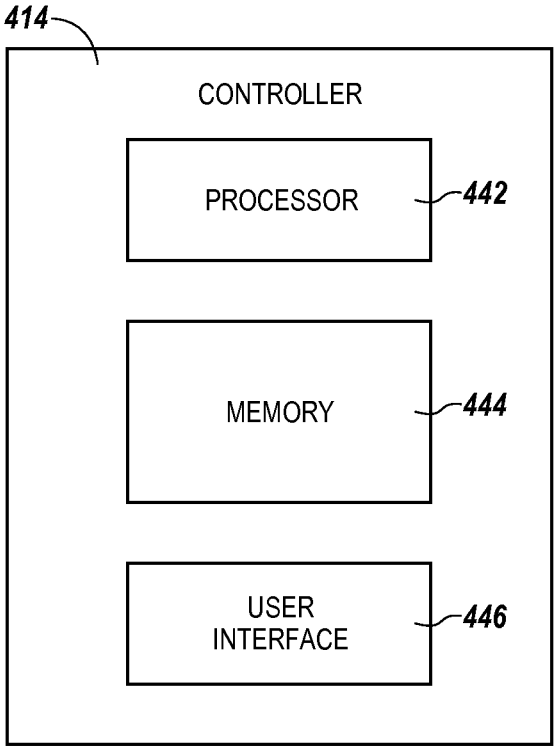
FIG. 4 illustrates an example of a controller for a boiler of an HVAC system in accordance with one or more embodiments of the present disclosure.

FIG. 4 illustrates an example of a controller 414 for a boiler of an HVAC system in accordance with one or more embodiments of the present disclosure. Controller 414 can be, for example, controller 114, 214, and/or 314 previously described in connection with FIGS. 1, 2, and 3, respectively.

As shown in FIG. 4, controller 414 can include a memory 444 and a processor 442. Memory 444 can be any type of storage medium that can be accessed by processor 442 to perform various examples of the present disclosure. For example, memory 444 can be a non-transitory computer readable medium having computer readable instructions (e.g., computer program instructions) stored thereon that are executable by processor 442 to control an HVAC boiler in accordance with the present disclosure. That is, processor 442 can execute the executable instructions stored in memory 444 to control an HVAC boiler in accordance with the present disclosure.

Memory 444 can be volatile or nonvolatile memory. Memory 444 can also be removable (e.g., portable) memory, or non-removable (e.g., internal) memory. For example, memory 444 can be random access memory (RAM) (e.g., dynamic random access memory (DRAM) and/or phase change random access memory (PCRAM)), read-only memory (ROM) (e.g., electrically erasable programmable read-only memory (EEPROM) and/or compact-disk read-only memory (CD-ROM)), flash memory, a laser disk, a digital versatile disk (DVD) or other optical disk storage, and/or a magnetic medium such as magnetic cassettes, tapes, or disks, among other types of memory.

Further, although memory 444 is illustrated as being located in controller 414, embodiments of the present disclosure are not so limited. For example, memory 444 can also be located internal to another computing resource (e.g., enabling computer readable instructions to be downloaded over the Internet or another wired or wireless connection).

As shown in FIG. 4, controller 414 can include a user interface 446. A user (e.g., operator) of controller 414 can interact with controller 414 via user interface 446. For example, user interface 446 can provide (e.g., display and/or present) information to the user of controller 414, such as, for instance, an indication of a failure of an outdoor temperature sensor, as previously described herein. Further, user interface 446 can receive information from (e.g., input by) the user of controller 414.

In some embodiments, user interface 446 can be a graphical user interface (GUI) that can include a display (e.g., a screen) that can provide and/or receive information to and/or from the user of controller 414. The display can be, for instance, a touch-screen (e.g., the GUI can include touch-screen capabilities). Embodiments of the present disclosure, however, are not limited to a particular type(s) of user interface.

Although specific embodiments have been illustrated and described herein, those of ordinary skill in the art will appreciate that any arrangement calculated to achieve the same techniques can be substituted for the specific embodiments shown. This disclosure is intended to cover any and all adaptations or variations of various embodiments of the disclosure.

It is to be understood that the above description has been made in an illustrative fashion, and not a restrictive one. Combination of the above embodiments, and other embodiments not specifically described herein will be apparent to those of skill in the art upon reviewing the above description.

The scope of the various embodiments of the disclosure includes any other applications in which the above structures and methods are used. Therefore, the scope of various embodiments of the disclosure should be determined with reference to the appended claims, along with the full range of equivalents to which such claims are entitled.

In the foregoing Detailed Description, various features are grouped together in example embodiments illustrated in the figures for the purpose of streamlining the disclosure. This method of disclosure is not to be interpreted as reflecting an intention that the embodiments of the disclosure require more features than are expressly recited in each claim.

Rather, as the following claims reflect, inventive subject matter lies in less than all features of a single disclosed embodiment. Thus, the following claims are hereby incorporated into the Detailed Description, with each claim standing on its own as a separate embodiment.

What is claimed:

1. A controller for a boiler of a heating, ventilation, and air conditioning (HVAC) system, comprising:

a memory; and a processor configured to execute executable instructions stored in the memory to:

receive a weather forecast and current outdoor temperature for an area in which the boiler of the HVAC system is located, wherein the weather forecast and current outdoor temperature are received from a server via a network;

receive a current outdoor temperature from a temperature sensor;

determine a failure of the temperature sensor has occurred based on a comparison of the current outdoor temperature received from the temperature sensor and the current outdoor temperature received from the server;

determine a set point of the boiler based, at least in part, on the received weather forecast and the current outdoor temperature received from the server, and not based on the current outdoor temperature received from the temperature sensor, upon determining the failure of the temperature sensor has occurred; and adjust the set point of the boiler to the determined set point.

2. The controller of claim 1, wherein the processor is configured to execute the instructions to adjust an outdoor reset curve of the boiler based, at least in part, on the received weather forecast.

3. The controller of claim 1, wherein:

the weather forecast includes a forecast temperature for the area in which the boiler is located; and the processor is configured to execute the instructions to determine the set point of the boiler based, at least in part, on the forecast temperature.

4. The controller of claim 1, wherein the adjustment of the set point of the boiler includes a decrease of the set point of the boiler upon the weather forecast indicating a temperature in the area in which the boiler is located will increase above a particular temperature or will increase by more than a particular amount within a particular amount of time.

5. The controller of claim 1, wherein the set point of the boiler is a set point of a supply water temperature or a maximum firing rate of the boiler.

6. The controller of claim 1, wherein the processor is configured to execute the instructions to receive the weather forecast for the area periodically.

7. A method of operating a boiler of a heating, ventilation, and air conditioning (HVAC) system, comprising:

receiving, by a controller of the boiler of the HVAC system, a current outdoor temperature for an area in which the boiler of the HVAC system is located, wherein the current outdoor temperature is received from a server via a network;

receiving, by the controller, a current outdoor temperature from a temperature sensor;

determining by the controller, a failure of the temperature sensor has occurred based on a comparison of the current outdoor temperature received from the temperature sensor and the current outdoor temperature received from the server;

determining, by the controller, a set point of the boiler based, at least in part, on the current outdoor temperature received from the server, and not based on the current outdoor temperature received from the temperature sensor, upon determining the failure of the temperature sensor has occurred; and adjusting, by the controller, the set point of the boiler to the determined set point.

8. The method of claim 7, wherein the method includes:

receiving, by the controller, a weather forecast for an area in which the boiler is located; and determining, by the controller, the set point of the boiler based, at least, in part, on the received weather forecast.

9. The method of claim 8, wherein the weather forecast includes the current outdoor temperature received from the server.

10. The method of claim 8, wherein:

the weather forecast includes a current humidity, a current wind speed, and a current sunlight intensity for the area in which the boiler is located; and the method includes determining, by the controller, the set point of the boiler based, at least in part, on the current humidity, the current wind speed, and the current sunlight intensity.

11. The method of claim 7, wherein the method includes receiving, by the server, the current outdoor temperature from a controller of a boiler of an additional HVAC system located in the area.

12. The method of claim 7, wherein the the current outdoor temperature received by the controller from the server is received by the server from a weather forecast service.

13. The method of claim 7, wherein the method includes sending, by the controller to the server via the network, a geographic location of the boiler.

14. A system for controlling a boiler of a heating, ventilation, and air conditioning (HVAC) system, comprising:

a temperature sensor configured to sense a current outdoor temperature; and a controller configured to:

receive the sensed current outdoor temperature from the temperature sensor;

receive a current outdoor temperature from a server via a network;

determine a failure of the temperature sensor has occurred based on a comparison of the current outdoor temperature sensed by the temperature sensor and the current outdoor temperature received from the server; and adjust a set point of the boiler based on the current outdoor temperature received from the server, and not based on the current outdoor temperature received from the temperature sensor, upon determining the failure of the temperature sensor has occurred.

15. The system of claim 14, wherein the controller is configured to:

receive, from the server via the network, a weather forecast for an area in which the boiler system is located; and adjust the set point of the boiler based, at least in part, on the received weather forecast.

16. The system of claim 15, wherein:

the weather forecast includes a forecast wind speed and a forecast sunlight intensity for the area in which the boiler is located; and the controller is configured to adjust the set point of the boiler based, at least in part, on the forecast wind speed and the forecast sunlight intensity.

17. The system of claim 14, wherein the controller is configured to provide a notification of the failure of the temperature sensor to a user.

18. The system of claim 14, wherein the controller is configured to adjust the set point of the boiler based, at least in part, on an outdoor reset curve of the boiler.

* * * * *